US005178389A

United States Patent [19]

Bentley et al.

[11] Patent Number: 5,178,389

[45] Date of Patent: Jan. 12, 1993

[54] HAND-HELD ELECTRONIC GAMBLING GAME DEVICE

[75] Inventors: John Bentley, 2a Seymour Walk, London SW10; Gordon McNally, London, both of England

[73] Assignee: John Bentley, London, England

[21] Appl. No.: 700,040

[22] Filed: May 7, 1991

Related U.S. Application Data

[63] Continuation of Ser. No. 438,395, Jan. 23, 1990, abandoned.

[30] Foreign Application Priority Data

Apr. 20, 1988 [GB] United Kingdom ..... 8809363
Nov. 30, 1988 [GB] United Kingdom ..... 8827944

[51] Int. Cl.[5] ..... A63F 9/24; A63F 1/00

[52] U.S. Cl. ..... 273/138 A; 273/143 R; 273/85 CP; 273/433

[58] Field of Search ..... 273/433, 434, 85 R, 273/85 G, 85 LP, 138 R, 138 A, 143 R, 237, 269

[56] References Cited

U.S. PATENT DOCUMENTS

| | | | |
|---|---|---|---|
| 4,299,388 | 11/1981 | Resch et al. | 273/143 R |
| 4,573,681 | 3/1986 | Okada | 273/143 R |
| 4,593,376 | 6/1986 | Volk | 273/85 G |
| 4,712,799 | 12/1987 | Fraley | 273/138 A |
| 4,747,600 | 5/1988 | Richardson | 273/269 |

*Primary Examiner*—V. Millin
*Assistant Examiner*—Jessica J. Harrison
*Attorney, Agent, or Firm*—Wenderoth, Lind & Ponack

[57] ABSTRACT

A game device, preferably hand-held, has an electronic display pattern generator, a display, and a play button to initiate generation of a game which displays sets of symbols which "rotate" after the manner of a fruit machine and which can be held from "rotating" by a hold button. The device includes the capability of limiting the number of games playable, and a lock button allows a winning display to be locked irrevocably to establish proof of a win.

7 Claims, 2 Drawing Sheets

HAND-HELD ELECTRONIC GAMBLING GAME DEVICE

This application is a continuation of now abandoned application, Ser. No. 07/438,395 filed on Jan. 23, 1990 now abandoned.

BACKGROUND OF THE INVENTION

The present invention relates to an electronic game device.

SUMMARY OF THE INVENTION

According to one aspect of the present invention there is provided an electronic game device having:

(a) a display;

(b) an electronic generator for generating different display patterns at the display;

(c) operator controlled play means for initiating a game, the play means causing the generator to generate a display pattern;

(d) means for limiting the number of games it is possible to play; and (e) operator controlled lock means for locking the device irrevocably against further plays and preserving a generated pattern.

Preferably the display is visual, being given by lights or a liquid crystal display arrangement, for example. However, the display may be audible, being given by a transducer and taking the form, for example, of a sequence of notes which may make a tune. The term "display" is to be interpreted accordingly. A visual display may have associated with it an audible output if desired.

The electronic generator may be based on a random number generator and the display patterns may be given in a random manner. In one form of the invention the device is small and hand-held, being inexpensive and intended for mass production and individual use. Here the electronic generator may comprise a random number generator but there is an alternative possibility: the patterns may be predetermined and programmed into the game. With such an arrangement, there will be, in a large number of game devices, different pattern sequences. A few of the game devices will include winning sequences and many will not. Randomness is achieved by the random distribution of the game devices to players.

The operator controlled play means may be a play button. Alternatively, there may be sound or light activated switches for this purpose.

The means for limiting the number of games may be resettable. Generally, resetting will not be possible by the operator but only on return to the manufacturer. However, there is a special case in which a feature of the invention provides an electric key as the reset means, and according to another aspect of the invention such a key comprises a casing including an electric cell or battery and a pair of contacts accessible from the exterior of the casing connected to the cell or battery, the key and device being such that the key can be connected via the contacts to the device and current drawn by the device from the cell or battery to operate the device, the arrangement being such that once current has been drawn, the key cannot be removed and reused.

The cell or battery may comprise a single button cell of such characteristics that it is effectively discharged immediately after it is connected to the device. In an alternative arrangement there is a fuse encapsulated in the casing and connected in series with the battery. The fuse blows as soon as current is drawn. It will be seen that the key of the present invention is not designed to provide power to drive the device but merely to trigger it.

Another kind of reset key envisaged is a specially programmed smart card.

The electronic generator and the means for limiting the number of games preferably form part of a pre-programmed microprocessor unit.

The lock means is preferably a switch, perhaps button operated, which freezes the pattern generated. The pattern may remain displayed, in the case of a visual display, or may be locked into the micro-processor memory for reproduction, in the case of a visual or audible display.

The purpose of the game is to play until a predetermined winning pattern, or one of a number of predetermined winning patterns is generated and displayed. Thereafter the display is locked so that the win can be subsequently verified.

The game can be used for amusement or gaming. Achievement of a winning pattern will give entitlement to a prize. In the amusement use one of a party of players may be awarded a prize or achievement of a winning pattern. In the gaming use a game device may be purchased with a fixed number of games available and a monetary prize awarded for a winning pattern.

Different winning patterns may be entitled to different prizes. Some of the less valuable winning patterns may simply step up the limit of games available, thus giving a number of free plays. Such winning patterns would not be locked.

A preferred form of the display is a set of numbers or other symbols displayed in respective windows and independently changed to achieve different combinations after the manner of a fruit machine.

A system where the sequence of patterns is predetermined has the advantage that there is no problem in maintaining security against tampering and falsifying winning displays since winning devices can be identified by a secret code number. However, such a system has the problem of maintaining security against unauthorised identification of the winning devices.

Where the patterns generated are truly random, any device may produce a winning pattern. The device is physically sealed against tampering and preferably encapsulated in resin. Power may be provided by batteries or solar cells. Incorporation of holograms and other anti-forgery devices is envisaged.

BRIEF DESCRIPTION OF THE DRAWINGS

One embodiment of the invention will be described with reference to the accompanying drawings, of which.

DESCRIPTION OF THE PREFERRED EMBODIMENT

Figure 1:
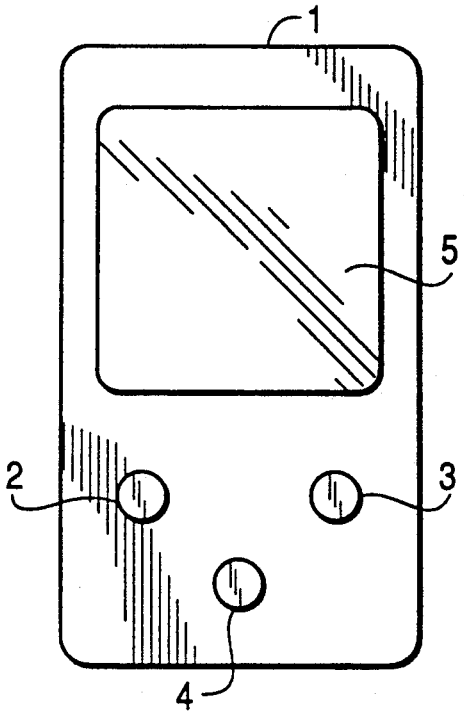
FIG. 1 is a front elevation of a handheld electronic game device according to the invention.
Figure 2:
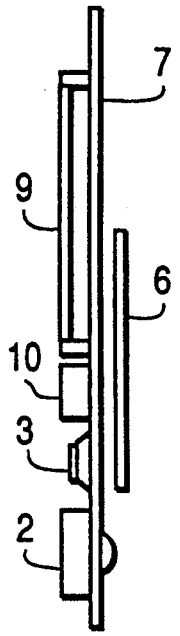
FIG. 2 is a side elevation showing the disposition of components in the device of FIG. 1.

Referring to FIG. 1 the device comprises a housing 1 formed in two halves and welded about a set of components shown in FIG. 2. The case has a play push-button 2, a hold push-button 3 and a lock push-button 4 which is recessed to be difficult to push accidentally. A display panel 5 shows a liquid crystal display (LCD) to be described more fully with reference to FIG. 3.

FIG. 2 shows components of the device. Apart from a piezoelectric buzzer 6 which is mounted in a recess in the rear housing moulding, the components are mounted on a printed circuit board 7. FIG. 2 shows one of two side-by-side batteries 8, push-button 3, and the LCD 9. The device is controlled by a programmed microprocessor chip 10 encapsulated in resin.

Figure 3:
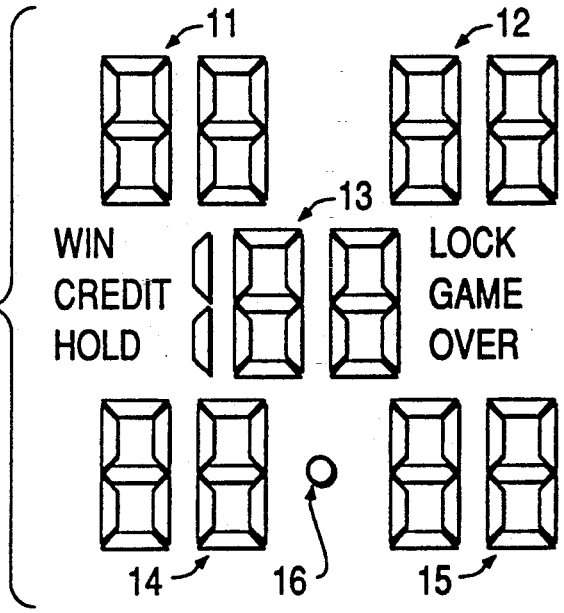
FIG. 3 is a view of the display of the device.

FIG. 3 shows the form of the display which is arranged as a group of five areas arranged in an 'X', hereinafter referred to as windows 11, 12, 13, 14 and 15. Each window displays a number. The numbers in the corner windows 11, 12, 14 and 15 have two digits each. The number in the centre window 13 has an extra reading "half-digit" available: the first digit in the centre window may be a '1'. In addition to the five windows there is a central dot 16 available between windows 14 and 15. Furthermore, the following displays are possible between windows 11 and 14: "WIN"; "CREDIT" and "HOLD". Between windows 12 and 15 the following displays are available: "LOCKED"; "GAME" and "OVER". Reels 1–5 will be identified respectively with windows 11, 12, 15, 14 and 13.

Operation of the device will now be described. By analogy to a fruit machine, windows 11 to 15 will be described as "reels". A reel listing of 80 symbols controls the numbers displayed in each position, reels 1 & 4 and reels 2 & 3 share the same reel data. Only the numbers 00, 04, 05, 06, 07, 08, 09, 11, 22, 33, 44, 55, 66, 77, 88 and 99 are used. This uses only 16 different game symbols to allow for easier storage within the microcomputer and uses the '00' as a losing symbol.

The distribution of symbols on each of the reels is as follows:

| Symbol | Reels 1 & 4 | Reels 2 & 3 | Reel 5 |
|---|---|---|---|
| '00' | 13 | 13 | 12 |
| '04' | 8 | 8 | 7 |
| '05' | 17 | 12 | 11 |
| '06' | 1 | 2 | 3 |
| '07' | 3 | 6 | 7 |
| '08' | 2 | 2 | 3 |
| '09' | 5 | 5 | 4 |
| '11' | 3 | 4 | 5 |
| '22' | 1 | 1 | 2 |
| '33' | 4 | 5 | 6 |
| '44' | 4 | 2 | 3 |
| '55' | 3 | 3 | 4 |
| '66' | 6 | 2 | 4 |
| '77' | 3 | 5 | 3 |
| '88' | 3 | 5 | 3 |
| '99' | 4 | 5 | 3 |
| | 80 | 80 | 80 |

Note that in order to reduce the storage requirement for these reels so that it can be fitted into the limited ROM space available, the reels are stored in a compacted form. A list of 64 symbols is used as the first 64 symbols of ALL FIVE reels. This is followed by 3 different tables each of 16 symbols which hold the last 16 symbols of reels 1 & 4, 2 & 3 and 5 respectively. This gives the symbol distribution required without affecting the 'randomness' of the games.

ASSEMBLY AND TEST

When the device is first powered up, the program enters 'TEST' mode and waits for the PLAY or LOCK buttons to be pressed. When the 'PLAY' button is pressed, all LCD segments are lit until the PLAY button is released. When the 'HOLD' button is pressed a 'lose' tune is played.

These tests can be performed as often as required and test the operation of the microprocessor, the PLAY and HOLD buttons, LCD and buzzer. Note that the units must be inspected carefully during this operation to ensure that the device will play correctly.

When the test sequences have been performed, the LOCK button must be pressed to lock the device. The device will play its 'win tune' to show that it has been locked. Note that it can be checked that the device has indeed been locked correctly by pressing the PLAY button and confirming that the LCD does not light with the test pattern.

Pressing the LOCK button sets the state of the device to 'SHIPPING', so that it can be stored and shipped to the customer. In this state the LCD display is turned off and the processor is Halted to conserve battery power. The device will remain 'asleep' until the 'LOCK' button is pressed again.

OPERATION

When the customer receives the device, the display is blank. Instructions with the device tells him to press the LOCK button to start. When this is pressed, the 'win tune' will be played and the display will light showing '00' on all five reels. The device can then be played by the customer with the assurance that it is indeed 'new' and contains the stated number of games.

When the PLAY button is pressed, the reels will start "spinning". In other words, rapidly changing numbers will appear. After 2 seconds the device will 'beep' again telling the player that he can stop each of the "spinning" reels in turn by pressing the PLAY button. If the player does not stop the reels himself, they will stop automatically, at 10 second intervals. Thus each game will take a minimum of 3 seconds to complete, if the player stops all the reels immediately, and a maximum of 50 seconds if the reels are allowed to stop automatically.

When each reel stops "spinning", the device will generate a new random number, which will be converted to the corresponding game symbol (numbers 00, 04, 22, etc) which will be displayed on the LCDs.

"Spinning" reels are shown by rapidly changing numbers being displayed. The generation of these numbers exercises the random number generator, as does the loop that waits for the play button to be pressed at the start of each game. Thus the whole device will not follow a predetermined sequence of wins or loses since the user affects the outcome of each game in a random manner.

Each time the reels are "spun", the number of games left will be decremented. If this value falls to 10 or below, the LCD dot 16 for 10 games or less remaining will be lit.

To prevent the player pressing the PLAY button once too often when stopping the reels and so causing a new game to be started immediately, the device will wait after the reels have stopped spinning (and lighting the win or hold lights if appropriate) until all buttons have been released.

WIN TESTING

After each game, the program will test the resulting display to see if it is a winning combination. The program will treat as wins all combinations of 3 identical symbols in a diagonal line (reels 1=3=5 or 2=4=5), 4 corners the same (reels 1=2=3=4) and all 5 the same. If it finds such a combination the device will light the "WIN" display segment, play the WIN tune and flash the winning combination for a few seconds.

CREDIT WINS

Different combinations have different probabilities and different prize entitlements. All wins below a predetermined limit of prize entitlement are "paid" by giving the player credits of extra games. These are awarded automatically by the device. After the win tune has been played and the winning line is flashed, the device blanks out all four corner reel displays and light the 'CREDIT' segment. The center digits show the number of extra games awarded. This is flashed for a few seconds. The winning reel combination is then redisplayed (not flashing) with the WIN segment still lit until the player presses the 'PLAY' button to start the next game.

The following 'credit wins' are programmed into the device and so these awards cannot be changed by altering the printing on the device. The figures are the number of extra games awarded automatically by the device.

| Symbol | 3 in a line | 4 corners |
|---|---|---|
| '04' | 10 | 40 |
| '05' | 20 | 50 |
| '06' | 20 | 60 |
| '07' | 40 | 80 |
| '08' | 40 | 100 |
| '09' | 50 | 150 |
| '11' | 50 | 150 |
| '22' | 60 | 150 |
| '33' | 80 | |
| '44' | 100 | |
| '55' | 100 | |

Note that up to 199 credits can be awarded in this way. The LOCK button is enabled even when these wins are paid out automatically by the game as credits. This is to allow the rules of the device to be changed at a later date to that the player might have the choice of having these smaller wins awarded as prizes instead of credits.

When credit wins are awarded, these are added to the number of games remaining and the dot 16 is cleared if necessary.

LOCK

When a winning combination is displayed, shown by the WIN segment being lit, the user has the chance to press the recessed LOCK button. Doing this will lock the game with the winning combination displayed so that it can be returned to the distributor and the prize claimed. The game will beep and the LOCK and GAME OVER display segments will also be lit to confirm that this has been done successfully and that the winning display cannot then be lost accidentally.

If the player locks a valid winning combination, the display will show the winning positions of the five reels, with the 'WIN', 'LOCKED' and 'GAME OVER' segments and the dot 16 all lit. A win claim should be regarded as valid only if the display is as described and ALL buttons are inactive.

Note that a winning combination is lost if the player presses PLAY instead of LOCK. This allows the player to gamble a low win but may lead to claims of accidentally losing a large win.

The device will also lock automatically when the player runs out of games.

HOLD

This allows the player to hold the number displayed in ONE of the five reels. The feature is available every game unless the previous play was held or was a winning combination (regardless of whether the win was claimed).

A 'HOLD' segment on the LCD lights to show when this feature is available. To allow the player to select which reel to hold, the game flashes each of the reels in turn, for 2 seconds each. The player can then press the 'HOLD' button to hold the reel that is flashing at that moment and the game will 'bleep' to confirm the hold. The 'HOLD' segment will be cleared and the selected reel will not 'spin' during the next game.

The hold is cancelled and the HOLD segment blanked when HOLD or PLAY is pressed or after the hold cycle of flashing each of the 5 reels has occurred 3 times.

Figure 4:
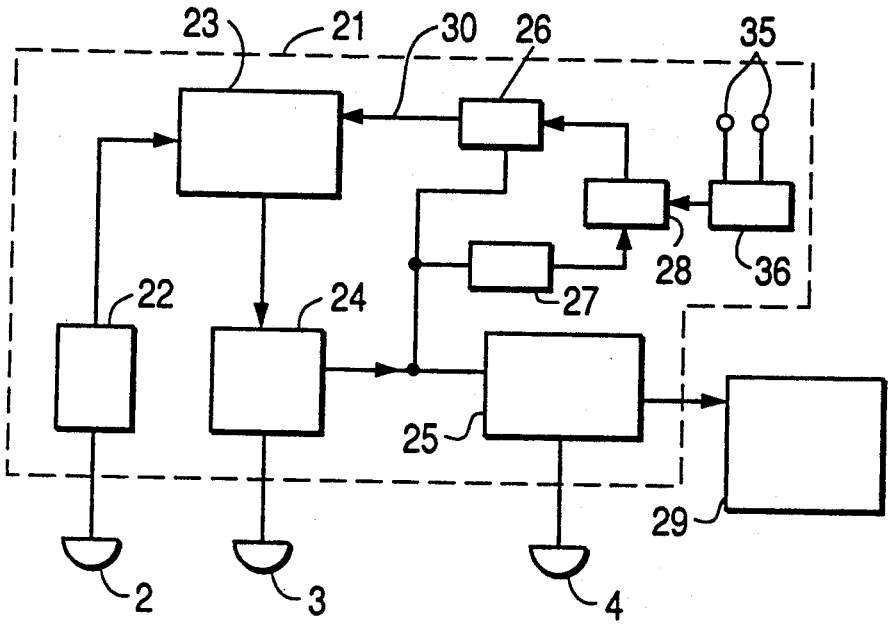
FIG. 4 is a schematic block circuit diagram of the device.

Referring now to FIG. 4 there is shown a block circuit diagram of the device. It is to be understood that this is an equivalent circuit diagram since the functions described are in fact implemented by the programmed microprocessor.

The circuit diagram shows an electronic generator 21 comprising a timing circuit 22; random number generator 23; a hold circuit 24 a display driver 25; a game counter 26; a score analyser 27 and a reset circuit 28. The display is shown at 29.

Play button 2 is connected to initiate the time 22. Under control of the timer, random numbers are issued from generator 23 for a certain time. The random number signals pass through a hold circuit which allows specific segments of the display to be held under control of the hold button 3. The random number signals are applied to the display device 25 and thence to the display 29. The lock button 4 is effective to lock the display driver. Operation of the lock button irrevocably locks the game so that no further plays are possible and the display is preserved, i.e. the lock button permenantly disables the display driver.

The game counter 26 counts the number of games played and when this reaches a predetermined total issues a disable signal over a line 30 to disable further operation of the random number generator. The score analyzer 27 determines whether the current display represents a minor win for adding credits. If so, the reset circuit 28 is activated accordingly for counting down the count in the counter 26 by the appropriate amount to give credit games.

Figure 5:
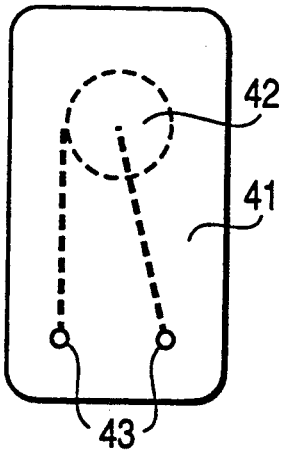
FIG. 5 is a diagram of an electric key in accordance with an aspect of the invention.

Referring to FIG. 5 the key is a flat plastic square casing 41 encapsulating a single button cell 42 connected to two metal studs 43 at the surface of the casing. A square recess (not shown) in the game casing accepts the key and contact is made via the studs to the game circuit. Current is drawn from the cell and the characteristics of the cell and the game circuit are such that the cell is immediately drained. It can no longer be used.

However, the current is sufficient to trigger the game for another hundred plays, for example.

Figure 6:
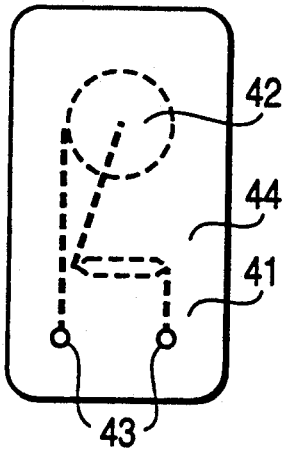
FIG. 6 is a diagram of another electric key in accordance with said aspect of the invention.

FIG. 6 shows a similar key. The difference is that this has an encapsulated fuse 44 in series with the cell, which is now no longer a special cell for rapid discharge. When the key is applied to the game, the current drawn blows the fuse and thus renders the key unusable again. Nevertheless, the one current pulse is sufficient to activate the game device for the required number of plays.

In FIG. 4 contacts in the device body are shown at 35. A sensing circuit 36 detects the key current and resets the counter 26 via the reset circuit 28. Thus, the predetermined number of plays is again available. However, it is to be noted that if the device has been locked by the lock button, resetting is not possible.

The use of an electric key or a suitably programmed smart card which may be used in an analogous manner, is possible if the device is a hand-held device as described or if the device is embodied in a fixed, for example wall-mounted, unit.

The invention also envisages the use of the electric key for operating other games and devices such as toys.

We claim:

1. An electronic game device comprising:

(a) a display having a display driver;

(b) an electronic generator for generating different display patterns on said display;

(c) an operator controlled play means for initiating a game, said play means causing said electronics generator to generate a display pattern;

(d) a means for limiting the number of games which can possibly be played; and (e) an operator controlled lock means for locking the device irrevocably against further plays by permanently disabling the display driver and preserving a generated pattern.

2. A game device as recited in claim 1, wherein said electronic generator includes a random number generator and the display patterns are provided in a random manner.

3. A game device as recited in claim 2, wherein timing of the operation of the play means determines the random numbers generated.

4. A game device as recited in any of the preceding claims, wherein said means for limiting the number of games comprises a counter which is resettable.

5. A game device as recited in claim 4, wherein credit games are provided and a means is provided for win pattern analysis and such means provides for partial resetting of said counter to provide said credit games.

6. A game device as recited in claim 4, wherein an electric key provides, on application to the device, a reset signal for said counter, said electric key comprising a casing including an electric cell or battery and a pair of contacts accessible from the exterior of said casing and connected to the cell or battery, said key and device being connectable via said contacts whereby current is drawn by the device from said cell or battery to operate the device, said key being incapable of re-use.

7. An electronic game device comprising:

(a) a display;

(b) an electronic generator for generating different display patterns on said display;

(c) an operator controlled play means for initiating a game, said play means causing said electronics generator to generate a display pattern;

(d) a resettable counter for limiting the number of games which can possibly be played;

(e) an operator controlled lock means for locking the device irrevocably against further plays and preserving a generated pattern; and (f) an electric key which provides a reset signal for said counter, said electric key comprising a casing including an electric cell or battery and a pair of contacts accessible from the exterior of said casing and connected to said cell or battery, said key and device being connectable via said contacts whereby current is drawn by the device from said cell or battery to operate the device, said key being incapable of re-use.

* * * * *